US008136965B2

(12) United States Patent
Pickard et al.

(10) Patent No.: US 8,136,965 B2
(45) Date of Patent: Mar. 20, 2012

(54) LIGHT FIXTURES AND LIGHTING DEVICES

(75) Inventors: Paul Kenneth Pickard, Morrisville, NC (US); Gary David Trott, Morrisville, NC (US)

(73) Assignee: Cree, Inc., Durham, NC (US)

( * ) Notice: Subject to any disclaimer, the term of this patent is extended or adjusted under 35 U.S.C. 154(b) by 435 days.

(21) Appl. No.: 12/116,346

(22) Filed: May 7, 2008

(65) Prior Publication Data

US 2008/0278950 A1 Nov. 13, 2008

Related U.S. Application Data

(60) Provisional application No. 60/916,407, filed on May 7, 2007, provisional application No. 61/029,068, filed on Feb. 15, 2008, provisional application No. 61/037,366, filed on Mar. 18, 2008.

(51) Int. Cl.
*F21V 29/00* (2006.01)

(52) U.S. Cl. ..... 362/294; 362/296.07; 362/373; 362/382

(58) Field of Classification Search ..... 362/373, 362/374, 375, 364, 367, 224, 294, 296.07, 362/382

See application file for complete search history.

(56) References Cited

U.S. PATENT DOCUMENTS

| | | | |
|---|---|---|---|
| 3,052,749 A | 9/1962 | Milton et al. | |
| 3,263,023 A | 7/1966 | Staley | |
| 4,689,442 A | 8/1987 | Ozaki | |
| 5,116,689 A | 5/1992 | Castro et al. | |
| 5,738,436 A * | 4/1998 | Cummings et al. | 362/294 |
| 5,876,831 A | 3/1999 | Rawal | |
| 6,045,240 A | 4/2000 | Hochstein | |
| D428,516 S | 7/2000 | Reo et al. | |
| D430,339 S | 8/2000 | Reo | |
| D437,446 S | 2/2001 | Reo et al. | |
| D443,949 S | 6/2001 | DiMonte | |
| 6,278,607 B1 | 8/2001 | Moore et al. | |
| 6,350,043 B1 | 2/2002 | Gloisten | |
| 6,441,943 B1 | 8/2002 | Roberts et al. | |

(Continued)

FOREIGN PATENT DOCUMENTS

EP 1 174 307 A2 1/2002

(Continued)

OTHER PUBLICATIONS

U.S. Appl. No. 11/613,714, filed Dec. 20, 2006.*

(Continued)

*Primary Examiner* — John A Ward
(74) *Attorney, Agent, or Firm* — Burr & Brown

(57) ABSTRACT

A lighting device comprises a heat sink, a housing mounted to and/or thermally coupled to the heat sink, a basket assembly attached to the housing, a solid state light emitter thermally coupled to the heat sink, and a baffle assembly attached to the housing. Also, a lighting device comprising a basket assembly and a baffle assembly. In some embodiments, the basket assembly comprises a first member defining a first opening, a second member, a space between the first and second members, and lenses in the opening and in the space. In some embodiments, the heat sink extends farther in a first direction in a first plane than a largest dimension of the housing in any plane which is parallel to the first plane. In some embodiments, at least one additional component (e.g., a power supply module or a junction box) is in contact with the heat sink element.

95 Claims, 7 Drawing Sheets

U.S. PATENT DOCUMENTS

| | | | | |
|---|---|---|---|---|
| 6,482,520 | B1 | 11/2002 | Tzeng | |
| 6,659,632 | B2 | 12/2003 | Chen | |
| 6,740,972 | B2 | 5/2004 | Smith et al. | |
| 6,788,541 | B1 | 9/2004 | Hsiung | |
| 6,789,921 | B1 | 9/2004 | Deloy et al. | |
| 6,791,257 | B1 | 9/2004 | Sato et al. | |
| 6,800,932 | B2 | 10/2004 | Lam et al. | |
| 6,805,474 | B2 | 10/2004 | Walser et al. | |
| 6,864,573 | B2 | 3/2005 | Robertson et al. | |
| 6,880,954 | B2 | 4/2005 | Ollet et al. | |
| 6,949,772 | B2 | 9/2005 | Shimizu et al. | |
| 7,030,486 | B1 | 4/2006 | Marshall | |
| 7,095,110 | B2 | 8/2006 | Arik et al. | |
| 7,121,688 | B2 | 10/2006 | Rempel | |
| 7,144,140 | B2 | 12/2006 | Sun et al. | |
| 7,210,832 | B2 | 5/2007 | Huang | |
| 7,213,940 | B1 * | 5/2007 | Van De Ven et al. | |
| 7,226,189 | B2 | 6/2007 | Lee et al. | |
| 7,234,844 | B2 | 6/2007 | Bolta et al. | |
| 7,258,475 | B2 | 8/2007 | Kurumatani | |
| 7,284,874 | B2 | 10/2007 | Jeong et al. | |
| 7,744,256 | B2 * | 6/2010 | Smester | 362/362 |
| 2004/0105247 | A1 | 6/2004 | Calvin et al. | |
| 2005/0051789 | A1 | 3/2005 | Negley et al. | |
| 2005/0077525 | A1 | 4/2005 | Lynch et al. | |
| 2005/0094105 | A1 | 5/2005 | Otsuka et al. | |
| 2005/0117332 | A1 | 6/2005 | Maack | |
| 2005/0128751 | A1 | 6/2005 | Robarge et al. | |
| 2005/0174780 | A1 | 8/2005 | Park | |
| 2005/0237739 | A1 | 10/2005 | Lee et al. | |
| 2006/0061539 | A1 | 3/2006 | Song et al. | |
| 2006/0098440 | A1 | 5/2006 | Allen | |
| 2006/0187660 | A1 | 8/2006 | Liu | |
| 2006/0262545 | A1 | 11/2006 | Piepgras et al. | |
| 2007/0074755 | A1 | 4/2007 | Eberspacher et al. | |

FOREIGN PATENT DOCUMENTS

| | | | |
|---|---|---|---|
| EP | 1 512 902 | A2 | 3/2005 |
| EP | 1 586 814 | A2 | 10/2005 |
| JP | 09-055457 | | 2/1997 |
| JP | 11-264668 | | 9/1999 |
| WO | 2008079161 | | 7/2008 |

OTHER PUBLICATIONS

U.S. Appl. No. 11/736,761, filed Apr. 18, 2007.*
U.S. Appl. No. 11/736,799, filed Apr. 18, 2007.*
U.S. Appl. No. 11/936,163, filed Nov. 7, 2007.*
U.S. Appl. No. 12/117,122, filed May 8, 2008.*
U.S. Appl. No. 12/117,131, filed May 8, 2008.*
U.S. Appl. No. 11/843,243, filed Aug. 22, 2007.*
U.S. Appl. No. 11/948,021, filed Nov. 30, 2007.*
U.S. Appl. No. 11/951,626, filed Dec. 6, 2007.*
U.S. Appl. No. 29/279,583, filed May 3, 2007.*
U.S. Appl. No. 29/324,484, filed Sep. 12, 2008.*
U.S. Appl. No. 29/279,586, filed May 3, 2007.*
U.S. Appl. No. 29/324,486, filed Sep. 12, 2008.*
U.S. Appl. No. 12/116,341, filed May 7, 2008.*
U.S. Appl. No. 12/117,271, filed May 8, 2008.*
U.S. Appl. No. 12/174,053, filed Jul. 16, 2008.*
U.S. Appl. No. 29/324,488, filed Sep. 12, 2008.*
U.S. Appl. No. 12/116,348, filed May 7, 2008.*
U.S. Appl. No. 11/673,951, filed Feb. 12, 2007.*
U.S. Appl. No. 11/379,709, filed Apr. 21, 2006.*
U.S. Appl. No. 11/379,726, filed Apr. 21, 2006.*
U.S. Appl. No. 11/408,767, filed Apr. 21, 2006.*
U.S. Appl. No. 60/990,435, filed Nov. 27, 2007.*
U.S. Appl. No. 29/298,299, filed Dec. 3, 2007.*
Focal Point Web Material, "Focal Point® launches two dimensions of popular Sky™ family", date: 2002, p. 1.
Focal Point Web Material, "Sky™ 2×2", date: 2002, p. 1.
Cree, Inc., "Cree® Xlamp® 7090 XR-E Series LED Binning and Labeling," Application Note: CLD-AP08.000, 7pp (2006).
Cree, Inc., "Cree® Xlamp® 7090 XR-E Series LED Data Sheet," Datasheet: CLD-DS05.000, 10 pp (2006).
Cree, Inc., "Cree® Xlamp® 7090 XR-E Series LED Secondary Optics," Datasheet: CLD-DS07.000, 3 pp (2004-2006).
McMaster-Carr Supply Company, "Multipurpose Aluminum (Alloy 6061), specification sheets," Retrieved Dec. 14, 2006 from www.mcmaster.com/param/asp/Psearch2.asp?regTyp=parametric &act=psearch%F..., 3 pp.

* cited by examiner

LIGHT FIXTURES AND LIGHTING DEVICES

CROSS-REFERENCE TO RELATED APPLICATIONS

This application claims the benefit of U.S. Provisional Patent Application No. 60/916,407, filed May 7, 2007, the entirety of which is incorporated herein by reference.

This application claims the benefit of U.S. Provisional Patent Application No. 61/029,068, filed Feb. 15, 2008, the entirety of which is incorporated herein by reference.

This application claims the benefit of U.S. Provisional Patent Application No. 61/037,366, filed Mar. 18, 2008, the entirety of which is incorporated herein by reference.

FIELD OF THE INVENTION(S)

The present inventive subject matter relates to a light fixture. In some aspects, the present inventive subject matter relates to a light fixture for use with solid state light emitters, e.g., light emitting diodes (LEDs).

BACKGROUND OF THE INVENTION(S)

One particular type of light fixture is known as a lay-in luminaire, or a troffer. The lensed troffer is the most popular lay-in sold today. It is a commodity that is sold for use in applications where price is the primary buying consideration. For many decades, the recessed parabolic was the standard for high performance applications such as offices. The "parabolic" style troffer utilizes aluminum baffles to shield the light and maximize high angle shielding while sacrificing light on the walls. In recent years, the market has been moving away from the parabolics towards troffers with broader distributions for high performance applications.

A troffer is typically installed within a suspended ceiling grid system where one or more ceiling tiles are replaced with the troffer. Thus, the exterior dimensions of the troffer are typically sized to fit within the regular spacing of the ceiling tiles. In the United States, the spacing of the ceiling grid is often 2 foot (61 cm) by 2 foot (61 cm) and, therefore, troffers will typically have a dimension that is a multiple of 2 feet (61 cm). For example, many troffers are 2' (61 cm)×2' (61 cm) or 2' (61 cm)×4' (122 cm). Similar regular spacing is also provided in Europe but is provided in a metric unit of measure.

Conventional approaches to providing solid state lighting in a suspended ceiling grid system have included replacing fluorescent tubes with an LED lamp that directly replaced the tube. Such an approach utilized existing fluorescent troffer fixtures and replaced just the lamp.

Another approach to providing solid state lighting for a suspended ceiling grid system has been to provide an illuminated panel that is substantially coplanar with the ceiling tiles. Still other approaches have provided a solid state lighting luminaire that looks similar to a lensed troffer with a macro level lensed sheet being provided between the solid state light sources and the room.

A further challenge with solid state lighting arises from the relatively high light output from a relatively small area provided by solid state emitters. Such a concentration of light output may present challenges in providing solid state lighting systems for general illumination in that, in general, large changes in brightness in a small area may be perceived as glare and distracting to occupants.

Yet another challenge with providing a solid state lighting system for troffer application relates to the distance the luminaire may extend above the ceiling tile. While the area above a suspended ceiling may in many cases be quite deep, in some applications there may be obstructions or other constraints that limit the distance above the ceiling which the luminaire may extend. For example, in some applications the luminaire may not extend more than 5 inches (12.7 cm) above the ceiling tile. Such restriction in height may present difficulties in providing luminaires with a high shield angle, as such shield angles are typically provided by recessing the light source into the ceiling.

BRIEF SUMMARY OF THE INVENTIVE SUBJECT MATTER

It would be desirable to provide a luminaire which ensures that the luminous surfaces are revealed in a controlled and comfortable way from all potential viewing angles. In addition, it would be desirable to provide a luminaire in which maximum luminances are not greater than amounts that will create discomfort glare. In addition, it would be desirable to provide a luminaire wherein as an observer moves closer to or further from a luminaire, the changes in luminances of the fixture occur gradually to ensure comfort and to minimize striations or hot spots projected on walls. Further, it would be desirable to provide a luminaire wherein luminance ratios of the luminaire when viewed while stationary are balanced, and significant changes do not happen over relatively small distances. In accordance with some aspects of the present inventive subject matter, there are provided devices with such properties.

In a first aspect of the present inventive subject matter, there is provided a lighting device, comprising:

a heat sink element;

an upper housing mounted to the heat sink element;

a basket assembly attached to the upper housing;

at least one solid state light emitter thermally coupled to the heat sink element; and a baffle assembly attached to the upper housing, the baffle assembly comprising a plurality of side walls and an end region, the end region defining a light exit opening, the light exit opening defining a first substantially planar area, at least one of the side walls of the baffle assembly extending from the end region at an angle of less than 90 degrees relative to the first substantially planar area.

In some embodiments according to this aspect of the present inventive subject matter, the baffle assembly comprises four side walls, and the four side walls define a substantially frustopyramidal shape.

In some embodiments according to this aspect of the present inventive subject matter, the angle is between 18 degrees and 27 degrees. In some of such embodiments, the baffle assembly comprises four side walls, and the four side walls define a substantially frustopyramidal shape.

In some embodiments according to this aspect of the present inventive subject matter, the light exit opening is substantially square.

In a second aspect of the present inventive subject matter, there is provided a lighting device, comprising:

a heat sink element;

an upper housing mounted to the heat sink element;

a basket assembly attached to the upper housing;

at least one solid state light emitter thermally coupled to the heat sink element; and a baffle assembly attached to the upper housing, the basket assembly comprising at least a first frame, the first frame comprising at least one first frame member and at least one second frame member, the first frame member defining a first opening, at least one first lens being positioned in the first opening, at least one space being provided between the first frame member and the second frame member, at least one second lens being provided in the space.

In some embodiments according to this aspect of the present inventive subject matter, the first frame consists of the first frame member and the second frame member, and the second lens covers an entirety of the space between the first frame member and the second frame member.

In some of such embodiments:

the first frame consists of the first frame member and first, second, third and fourth second frame members, a first space is located between the first second frame member and the first frame member, a second space is located between the second frame member and the first frame member, a third space is located between the third second frame member and the first frame member, a fourth space is located between the fourth second frame member and the first frame member, the first opening is a central opening and is substantially square, and second lenses are provided in each of the first, second, third and fourth spaces.

In some embodiments according to this aspect of the present inventive subject matter, the lighting device further comprises at least one diffusing film mounted on the first lens.

In a third aspect of the present inventive subject matter, there is provided a lighting device, comprising:

a heat sink element;

an upper housing mounted to the heat sink element;

a basket assembly attached to the upper housing;

at least one solid state light emitter thermally coupled to the heat sink element; and a baffle assembly attached to the upper housing, the heat sink element extending farther in a first direction which is in a first plane than a largest dimension of the upper housing in any plane which is parallel to the first plane.

In some embodiments according to this aspect of the present inventive subject matter, the largest dimension of the upper housing is in a second plane which is parallel to the first plane.

In some of such embodiments, the baffle assembly comprises a plurality of side walls and an end region, the end region defining a light exit opening, the light exit opening defining a first substantially planar area, the first plane being parallel to the first substantially planar area.

In some embodiments according to this aspect of the present inventive subject matter, the lighting device further comprises at least one additional component in contact with the heat sink element.

In some of such embodiments, (1) the heat sink element comprises a first side and a second side, the at least one additional component and the upper housing both being in contact with the first side of the heat sink element; (2) the at least one additional component comprises at least one element selected from among a power supply module and a junction box; and/or (3) the upper housing is thermally coupled to the heat sink element and/or the baffle assembly is thermally coupled to the upper housing.

In a fourth aspect of the present inventive subject matter, there is provided a lighting device, comprising:

a heat sink element;

an upper housing mounted to the heat sink element;

a basket assembly attached to the upper housing;

at least one solid state light emitter thermally coupled to the heat sink element;

a baffle assembly attached to the upper housing; and at least one additional component in contact with the heat sink element.

In some embodiments according to this aspect of the present inventive subject matter, the at least one additional component comprises at least one element selected from among a power supply module and a junction box.

In a fifth aspect of the present inventive subject matter, there is provided a lighting device, comprising:

a heat sink element;

an upper housing thermally coupled to the heat sink element;

a basket assembly attached to the upper housing;

at least one solid state light emitter thermally coupled to the heat sink element; and a baffle assembly attached to the upper housing.

In some embodiments according to this aspect of the present inventive subject matter, the lighting device further comprises at least one additional component in contact with the heat sink element. In some of such embodiments, the at least one additional component comprises at least one element selected from among a power supply module and a junction box.

In a sixth aspect of the present inventive subject matter, there is provided a lighting device, comprising:

a basket assembly; and a baffle assembly, the baffle assembly comprising a plurality of side walls and an end region, the end region defining a light exit opening, the light exit opening defining a first substantially planar area, at least one of the side walls of the baffle assembly extending from the end region at an angle of less than 90 degrees relative to the first substantially planar area.

In some embodiments according to this aspect of the present inventive subject matter, the baffle assembly comprises four side walls, and the four side walls define a substantially frustopyramidal shape.

In some embodiments according to this aspect of the present inventive subject matter, the angle is between 18 degrees and 27 degrees.

In some embodiments according to this aspect of the present inventive subject matter, the light exit opening is substantially square.

In some embodiments according to this aspect of the present inventive subject matter, the lighting device further comprises at least one light emitter.

In some embodiments according to this aspect of the present inventive subject matter, the basket assembly comprises at least one frame member and at least one lens. In some of such embodiments, the lighting device further comprises at least one diffusing film mounted on the lens.

In some embodiments according to this aspect of the present inventive subject matter, the basket assembly comprises at least a first frame, the first frame comprising at least one first frame member and at least one second frame member, the first frame member defining a first opening, at least one first lens being positioned in the first opening, at least one space being provided between the first frame member and the second frame member, at least one second lens being provided in the space. In some of such embodiments, the lighting device further comprises at least one light emitter.

In a seventh aspect of the present inventive subject matter, there is provided a lighting device, comprising:

a basket assembly; and a baffle assembly, the basket assembly comprising at least a first frame, the first frame comprising at least one first frame member and at least one second frame member, the first frame member defining a first opening, at least one first lens being positioned in the first opening, at least one space being provided between the first frame member and the second frame member, at least one second lens being provided in the space.

In some embodiments according to this aspect of the present inventive subject matter, the lighting device further comprises at least one light emitter.

In some embodiments according to this aspect of the present inventive subject matter, the first frame consists of the first frame member and the second frame member, and the second lens covers an entirety of the space between the first frame member and the second frame member.

In some embodiments according to this aspect of the present inventive subject matter:

the first frame consists of the first frame member and first, second, third and fourth second frame members, a first space is located between the first second frame member and the first frame member, a second space is located between the second frame member and the first frame member, a third space is located between the third second frame member and the first frame member, a fourth space is located between the fourth second frame member and the first frame member, the first opening is a central opening and is substantially square, and a second lens is provided in each of the first, second, third and fourth spaces.

In some embodiments according to this aspect of the present inventive subject matter, the lighting device further comprises at least one diffusing film mounted on the first lens.

In some lighting devices according to the present inventive subject matter, the at least one solid state light emitter is mounted on the heat sink.

In some lighting devices according to the present inventive subject matter, the lighting device further comprises a light emitter board mounted on the heat sink, the at least one solid state light emitter being mounted on the light emitter board, the light emitter board being thermally coupled to the heat sink, the at least one solid state light emitter being thermally coupled to the light emitter board. In some of such lighting devices, the basket assembly, the upper housing and the light emitter board together define a light mixing chamber.

In some lighting devices according to the present inventive subject matter, the at least one solid state light emitter is an LED.

In some lighting devices according to the present inventive subject matter, the lighting device comprises a plurality of solid state light emitters. In some of such lighting devices, each of the plurality of solid state light emitters is an LED.

In some lighting devices according to the present inventive subject matter, at least a portion of the upper housing is substantially frustopyramidal.

In some lighting devices according to the present inventive subject matter, efforts are made to maximize the heat transfer area of the lighting device and/or the overall heat capacity of the lighting device, in particular, by maximizing the area of the components with which the heat sink (which is thermally coupled to the solid state light emitter(s)) is thermally coupled. The expression "thermally coupled", as used herein, refers to components which readily transfer heat therebetween, e.g., components which are in contact with each other via a heat transfer gasket, thermal grease and/or thermal adhesive.

The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTIVE SUBJECT MATTER

Figure 1:
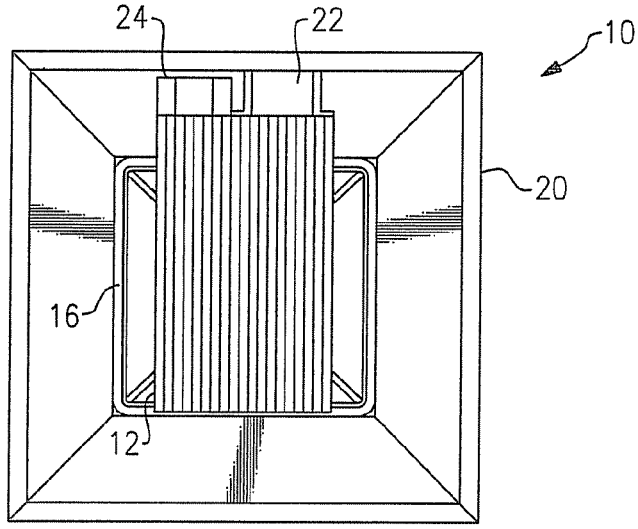
FIG. 1 is a top view of a first embodiment of a luminaire incorporating the present inventive subject matter.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Furthermore, relative terms, such as "lower" or "bottom" and "upper" or "top," may be used herein to describe one element's relationship to another element(s) as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, the term "substantially," e.g., in the expressions "substantially planar", "substantially frustopyramidal", or "substantially square" means at least about 95% correspondence with the feature recited, e.g.:

- the expression "substantially planar" means that at least 95% of the points in the surface which is characterized as being substantially planar are located on one of or between a pair of planes which are parallel and which are spaced from each other by a distance of not more than 5% of the largest dimension of the surface.
- the expression "substantially frustopyramidal", as used herein, means that at least 95% of the points in the surface which is characterized as being substantially frustopyramidal are located on one of or between a pair of imaginary frustopyramidal structures which are spaced from each other by a distance of not more than 5% of their largest dimension;
- the expression "substantially square" means that a square shape can be identified, wherein at least 95% of the points in the item which is characterized as being substantially square fall within the square shape, and the square shape includes at least 95% of the points in the item.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a component illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

Embodiments of the present inventive subject matter may be particularly well suited for use with systems for generating white light by combining a yellowish green highly unsaturated lamp (comprising a blue emitter and excess of yellow phosphor) with a red LED to produce white light, as described in:

(1) U.S. Patent Application No. 60/752,555, filed Dec. 21, 2005, entitled "LIGHTING DEVICE AND LIGHTING METHOD" (inventors: Antony Paul Van de Ven and Gerald H. Negley) and U.S. patent application Ser. No. 11/613,714, filed Dec. 20, 2006 (now U.S. Patent Publication No. 2007/0139920), the entireties of which are hereby incorporated by reference;

(2) U.S. Patent Application No. 60/793,524, filed on Apr. 20, 2006, entitled "LIGHTING DEVICE AND LIGHTING METHOD" (inventors: Gerald H. Negley and Antony Paul van de Ven) and U.S. patent application Ser. No. 11/736,761, filed Apr. 18, 200 7(now U.S. Patent Publication No. 2007/0278934), the entireties of which are hereby incorporated by reference;

(3) U.S. Patent Application No. 60/793,518, filed on Apr. 20, 2006, entitled "LIGHTING DEVICE AND LIGHTING METHOD" (inventors: Gerald H. Negley and Antony Paul van de Ven) and U.S. patent application Ser. No. 11/736,799, filed Apr. 18, 2007 (now U.S. Patent Publication No. 2007/0267983), the entireties of which are hereby incorporated by reference;

(4) U.S. Patent Application No. 60/857,305, filed on Nov. 7, 2006, entitled "LIGHTING DEVICE AND LIGHTING METHOD" (inventors: Antony Paul van de Ven and Gerald H. Negley; and U.S. patent application Ser. No. 11/936,163, filed Nov. 7, 2007 (now U.S. Patent Publication No. 2008/0106895), the entireties of which are hereby incorporated by reference;

(5) U.S. Patent Application No. 60/916,596, filed on May 8, 2007, entitled "LIGHTING DEVICE AND LIGHTING METHOD" (inventors: Antony Paul van de Ven and Gerald H. Negley), the entirety of which is hereby incorporated by reference;

(6) U.S. Patent Application No. 60/916,607, filed on May 8, 2007, entitled "LIGHTING DEVICE AND LIGHTING METHOD" (inventors: Antony Paul van de Ven and Gerald H. Negley), the entirety of which is hereby incorporated by reference;

(7) U.S. Patent Application No. 60/839,453, filed on Aug. 23, 2006, entitled "LIGHTING DEVICE AND LIGHTING METHOD" (inventors: Antony Paul van de Ven and Gerald H. Negley) and U.S. patent application Ser. No. 11/843,243, filed Aug. 22, 2007 (now U.S. Patent Publication No. 2008/0084685), the entireties of which are hereby incorporated by reference;

(8) U.S. Pat. No. 7,213,940, issued on May 8, 2007, entitled "LIGHTING DEVICE AND LIGHTING METHOD" (inventors: Antony Paul van de Ven and Gerald H. Negley), the entirety of which is hereby incorporated by reference;

(9) U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference;

(10) U.S. patent application Ser. No. 11/948,021, filed on Nov. 30, 2007 (now U.S. Patent Publication No. 2008/0130285), entitled "LIGHTING DEVICE AND LIGHTING METHOD" (inventors: Antony Paul van de Ven and Gerald H. Negley), the entirety of which is hereby incorporated by reference;

(11) U.S. Patent Application No. 60/868,986, filed on Dec. 7, 2006, entitled "LIGHTING DEVICE AND LIGHTING METHOD" (inventors: Antony Paul van de Ven and Gerald H. Negley), and U.S. patent application Ser. No. 11/951,626, filed Dec. 6, 2007 (now U.S. Patent Publication No. 2008/0136313), the entireties of which are hereby incorporated by reference;

(12) U.S. Patent Application No. 60/916,597, filed on May 8, 2007, entitled "LIGHTING DEVICE AND LIGHTING METHOD" (inventors: Antony Paul van de Ven and Gerald H. Negley) and U.S. Patent Application No. 60/944,848, filed Jun. 19, 2007, the entireties of which are hereby incorporated by reference; and

(13) U.S. Patent Application No. 60/990,435, filed on Nov. 27, 2007, entitled "WARM WHITE ILLUMINATION WITH HIGH CRI AND HIGH EFFICACY" (inventors: Antony Paul van de Ven and Gerald H. Negley), the entirety of which is hereby incorporated by reference.

However, the present inventive subject matter is not limited to such systems but may be used with any technique for generating light, e.g., generating light using a solid state light emitter. Thus, for example, the present inventive subject matter may be utilized with phosphor converted white light emitting diodes, RGB light emitting diode systems or other solid state light emitting systems that utilize a plurality of light emitters to produce a desired light output of the luminaire. Furthermore, while the present inventive subject matter is described with reference to white light generation, the present inventive subject matter may also be used with colored light or color changing light generation systems.

As noted above, in some aspects, the present inventive subject matter relates to lighting devices which comprise a basket assembly and a baffle assembly. In other aspects, the present inventive subject matter relates to lighting devices which comprise a heat sink element, an upper housing, a basket assembly, at least one solid state light emitter and a baffle assembly.

The heat sink element (if included) can be formed of any desired material (or combination of materials), a wide variety of which are readily available to and known by persons skilled in the art. In general, all other considerations being equal, materials (or composite materials) having greater thermal conductivity are desired. Representative examples of suitable materials include extruded aluminum and cast aluminum, with extruded aluminum being more desirable in many cases. If desired, the heat sink element can include a one or more materials dispersed in one or more other materials, e.g., where the dispersed materials are effective for carrying heat to a different region (e.g., carbon nanotubes, diamond slivers, etc.).

The upper housing (if included) can be formed of any desired material (or combination of materials), a wide variety of which are readily available to and known by persons skilled in the art. A representative example of a suitable material is aluminum, particularly where the upper housing is thermally coupled to the heat sink, whereby the upper housing can provide additional heat sinking capabilities. Skilled artisans are familiar with a wide variety of ways of forming aluminum (and/or other materials) into desired shapes (for example, aluminum can be formed, extruded aluminum can be formed into a desired shape, aluminum can be hyperformed, sheets of aluminum can be pushed into female molds, aluminum can be deep drawn or extruded and assembled, etc.).

The basket assembly can be formed of any desired material (or combination of materials), a wide variety of which are readily available to and known by persons skilled in the art. In some embodiments, the basket assembly comprises one or more frame elements and one or more lenses. The frame element(s) can be formed of any desired material (or combination of materials), a wide variety of which are readily available to and known by persons skilled in the art. Representative examples of suitable materials include injection-molded acrylonitrile-butadiene (ABS) and polycarbonate-acrylonitrile butadiene copolymer (PC/ABS). The lens(es) can be formed of any desired material (or combination of materials), a wide variety of which are readily available to and known by persons skilled in the art. Representative examples of suitable materials include polycarbonate (PC), acrylic (PMMA), cyclic olefin copolymer (COC), styrene-butadiene copolymer (SBC) or styrene-acrylonitrile (SAN). The lens (es) can be made by any desired method, e.g., injection molding. The lens(es) can be held in place relative to the frame element(s) in any desired way, a variety of which will be readily apparent to those skilled in the art, and any of which can be employed (e.g., the lens(es) can be molded into the frame element(s), snapped into the frame element(s) and/or heat-staked to the frame element(s)).

As noted above, any desired source of light can be included in the lighting devices according to the present inventive subject matter, skilled artisans being familiar with a wide variety of such lighting devices. For example, such lighting devices can be selected from among incandescent lights, fluorescent lights, solid state light emitters, etc.

Solid state light emitters are well-known to persons skilled in the art, and any of such solid state light emitters can be employed according to the present inventive subject matter.

LEDs are well-known to persons skilled in the art, and any of such LEDs can be employed according to the present inventive subject matter.

The baffle assembly can be made of any suitable material, a wide variety of which are well-known to those skilled in the art.

FIG. 1 is a top view of a first embodiment of a luminaire 10 according to the present inventive subject matter. As seen in FIG. 1, the luminaire 10 includes a heat sink 12, an upper housing 16, a baffle assembly 20, a power supply enclosure 22 and a junction box 24. The baffle assembly 20 has an overall dimension sized to fit in a conventional suspended ceiling grid system. For example, the overall dimension of the baffle assembly 20 may be 2' by 2'.

Figure 2:
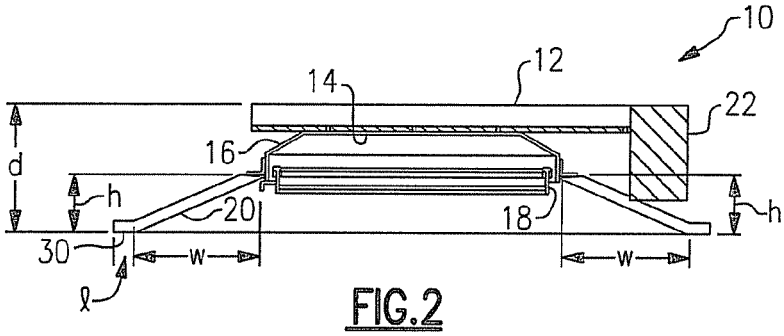
FIG. 2 is a cross-sectional view of the luminaire of FIG. 1 taken along lines A-A.
Figure 3:
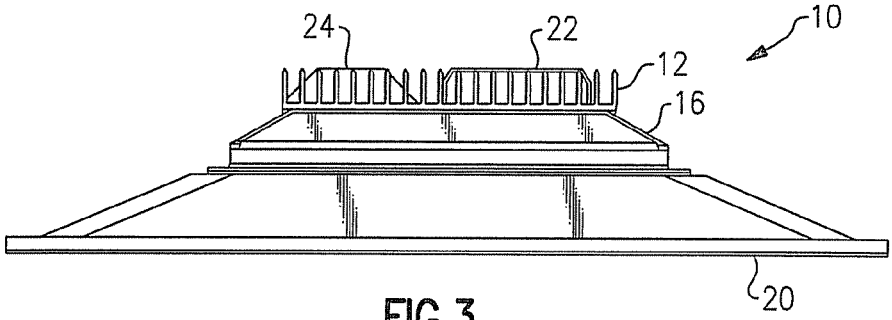
FIGS. 3-7 depict the troffer of FIG. 1 at various angles.
Figure 4:
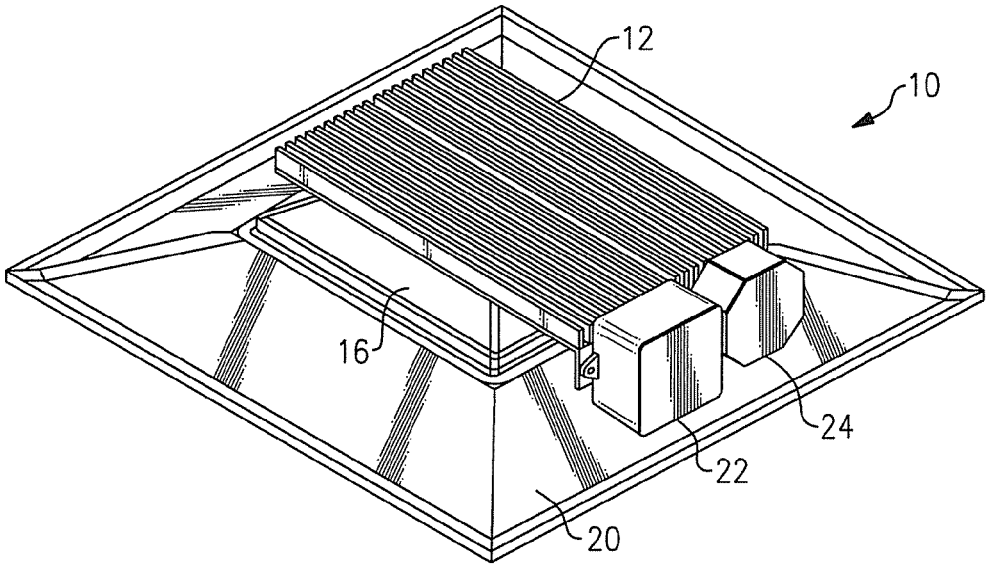
Figure 5:
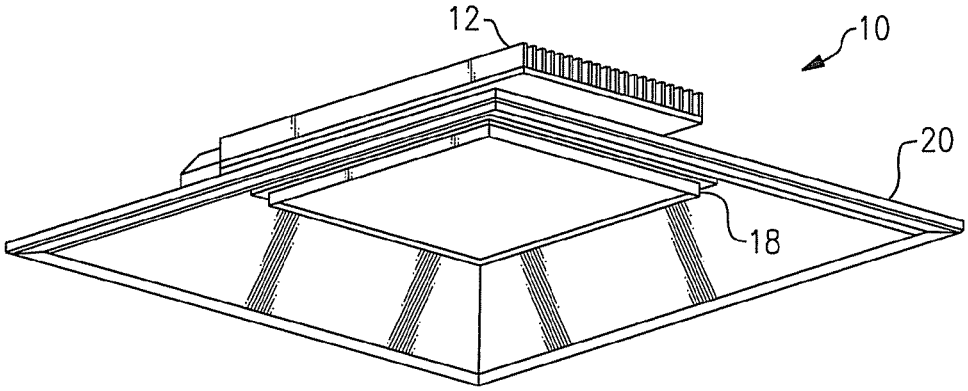
Figure 6:
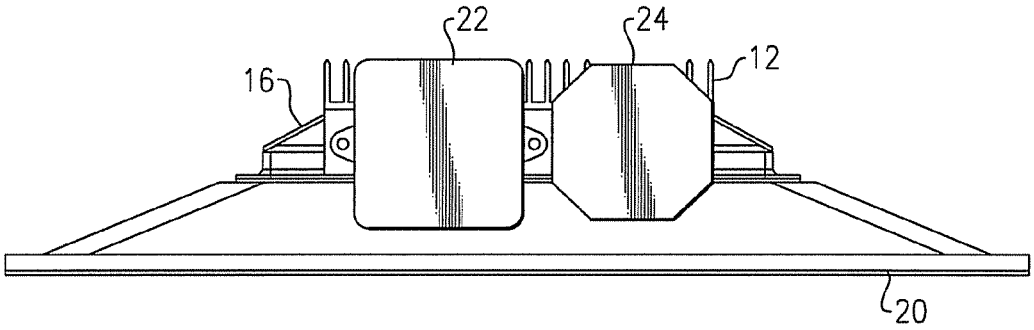
Figure 7:
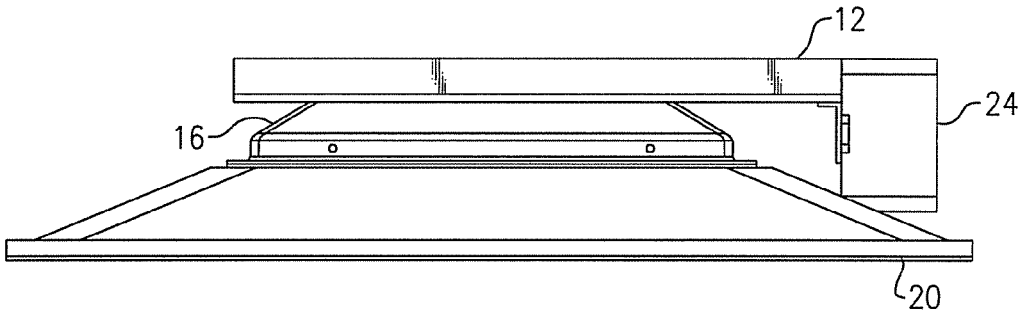

FIG. 2 is a cross-sectional view of the luminaire 10 of FIG. 1. As seen in FIG. 2, the luminaire 10 also includes a light emitter board 14 mounted on the heat sink 12. The light emitter board 14 includes a plurality of solid state light emitters, such as light emitting diodes (LEDs). In some embodiments, the light emitter board is a metal core printed circuit board on which the LEDs are mounted. The light emitter board 14 is thermally coupled to the heat sink 12 and may be thermally coupled to the heat sink 12 by direct contact, a thermal adhesive or other technique known to those of skill in the art. In some embodiments, the light emitter board 14 may be eliminated and the solid state light emitters may be mounted directly to the heat sink 12. In such embodiments, i.e., where the solid state light emitters are mounted directly to the heat sink, the heat sink can be made such that it is adaptable to having the solid state light emitters mounted directly thereon using techniques used in making metal core printed circuit boards, e.g., by including a sheet of metal for providing an interconnection structure (e.g., three strings of LEDs).

As is further illustrated in FIG. 2, the luminaire 10 also includes a light transmitting basket assembly 18. The basket assembly 18 may include a frame and one or more lenses. The lenses may, for example, be provided as an acrylic, polycarbonate, PET, PETG or other light transmissive material. Furthermore, the lens(es) may include diffusing structures formed therein, thereon or provided by one or more films as described below.

The basket assembly 18, the upper housing 16 and the light emitter board 14 provide a mixing chamber in which light emitted from the LEDs is mixed by a combination of reflection within the chamber and the optical properties of the diffusing structures and/or films of the basket assembly 18. Additionally, the interior surfaces of the mixing chamber may be covered in a reflective material, such as MCPET® from Furakawa Industries or any other reflective material, a wide variety of which are known by and available to persons skilled in the art (in some embodiments, particularly preferred reflective material is diffuse reflective material). Alternatively or additionally, any of the surfaces which light contacts can, in some embodiments, be coated with textured paint in order to alter brightness characteristics and/or patterns as desired.

Because many LEDs, such as Cree XRE LEDs, emit light in a substantially Lambertian distribution, the LEDs should be spaced from the sidewalls of the upper housing 16. Thus, the light emitter board will typically have a surface area that is smaller than the area defined by the opening of the upper housing 16 through which light passes. Accordingly, the upper housing or a portion of the upper housing may be substantially frustopyramidal and have sloped or slanted sidewalls 16 to direct light from the light emitter board 14 toward the basket assembly 18. Such slanted sidewalls may also help to direct light reflected from the basket assembly back toward the basket assembly so as to reduce light lost within the luminaire.

Additionally, because the light emitter board 14 has a smaller area than the basket assembly 18, the configuration of the basket assembly 18 and the upper housing 16 may be such as to spread the light from the LEDs across visible surfaces of the basket assembly 18 so as to avoid abrupt changes in luminance of the basket assembly 18 and the baffle assembly 20. This may be accomplished, for example, with the mechanical configuration of the basket as described in U.S. Provisional Patent Application Ser. No. 60/916,407 filed May 7, 2007, the disclosure of which is incorporated herein as if set forth in its entirety, or by the optical properties of the lens(es) of the basket assembly as described below.

The diffusing structures and/or films should be sufficiently diffusive to obscure individual sources of light when installed in a typical application, such as in an 8 foot to 10 foot ceiling. In some embodiments, the diffusing structures and/or films, alone or in combination with the other structures of the mixing chamber, diffuse light from the light sources such that variations in luminous intensity of an individual lens does not vary by more than 600% of the lowest luminous intensity over the visible surface of the lens. In other words, the ratio of the luminance of the brightest region of the visible surface of the lens to the luminance of the darkest region of the visible lens is no more than 6 to 1. In other embodiments, the luminous intensity of an individual lens does not vary by more than 500%, does not vary by more than 400%, more than 200% or more than 100% of the lowest luminous intensity of a visible region of the lens. As used herein, the luminous intensity of a region of a lens refers to the light output by a portion of the lens having an area of about 2 $cm^2$ or greater.

In some embodiments, the diffusing structures sand/or film (s), alone or in combination with the other structures of the mixing chamber, should also mix light from the light sources. Such properties may include the diffusion angle of any film or structure, the index of refraction of the material and the reflectivity of the materials. For example, as discussed above, light reflected from the basket assembly 18 may be recirculated within the mixing chamber with a portion of the light exiting the luminaire. As such, this recirculation may also serve to enhance the mixing of light from the LEDs.

In particular embodiments, the diffusing structures and/or film(s), alone or in combination with the other structures of the mixing chamber, may provide that a hue of light within an individual lens does not vary by more than 10 MacAdam ellipses on the 1931 CE Chromaticity Diagram (i.e., a hue of light within any region of the lens having an area of about 2 $cm^2$ or greater does not vary by more than 10 MacAdam ellipses from any other region of the lens having an area of about 2 $cm^2$ or greater). In other embodiments, hue of light within an individual lens does not vary by more than 7 MacAdam ellipses and in other embodiments by more than 4 MacAdam ellipses, in other embodiments by more than 2 MacAdam ellipses and in other embodiments by more than 1 MacAdam ellipse. In particular embodiments, the hue of light from individual lenses does not deviate by more than 10 MacAdam ellipses, by more than 7 MacAdam ellipses or more than 4 MacAdam ellipses from the black body locus.

In embodiments utilizing a film or films, the films may be mounted on the lens(es) or otherwise secured to the lenses or the frame of the basket assembly 18. Whether the film is mounted to the lens(es) may depend on the characteristics of the particular diffuser film or films utilized. Suitable films may be provided by, for example, Luminit of Torrance, Calif. or Fusion Optix of Cambridge, Mass. Additionally, films from different manufacturers may be combined in a single luminaire, either associated with different lenses or with the same lens. Thus, for example, a stack of films from different manufacturers with different properties may be utilized to achieve a desired light spreading, obscuration and/or mixing result.

Films and/or lenses can be made by any desired method, a wide variety of which are well-known to those of skill in the art. For example, in some embodiments, lenses with one or more films attached thereto can be made by film insert molding (e.g., as described in U.S. Patent Application No. 60/950,193, filed on Jul. 17, 2007, entitled "OPTICAL ELEMENTS WITH INTERNAL OPTICAL FEATURES AND METHODS OF FABRICATING SAME" (inventors: Gerald H. Negley and Paul Kenneth Pickard; and U.S. Patent Application No. 61/023,973, filed on Jan. 28, 2008, the entireties of which are hereby incorporated by reference) or by coextrusion.

Returning to FIG. 2, in some embodiments of the present inventive subject matter, the overall depth "d" of the luminaire 10 is about 5 inches (12.7 cm) or less. Such a shallow depth may present difficulties with providing sufficient heat sink area to adequately dissipate heat from the LEDs to maintain junction temperatures of the LEDs in a desired range. Thus, as seen in FIG. 2, rather than extending the heights of the fins of the heat sink 12 to increase the surface area of the heat sink 12, the lengths (i.e., lateral dimensions) of the fins of the heat sink 12 are extended past the periphery of the upper housing 16 so as to overhang the upper housing 16 (and/or additional fins are provided, e.g., parallel to the depicted fins, so that the heat transfer area is increased in a direction perpendicular to the planes defined by the major surfaces of the fins). Such an overhanging heat sink 12 takes advantage of the relatively small size of the lighted portion of the luminaire 10 formed by the upper housing 16 and the basket 18 in comparison to the overall size of the luminaire 10 as defined by the periphery of the baffle assembly 20. Furthermore, where a slanted baffle assembly 20 and a slanted upper housing 16 are provided, extending the heat sink 12 beyond the upper housing 16 so as to overhang the baffle 20 provides sufficient clearance to allow additional components to be mounted to the heat sink 12 without extending beyond the top of the heat sink, thereby increasing the overall depth of the luminaire 10. Thus, for example, the power supply module 22 may be mounted to the heat sink 12 without increasing the overall depth "d" of the luminaire 10.

With regard to the baffle assembly 20 of FIG. 2, the baffle assembly 20 includes a flat lip portion 30 that engages the grid of the suspended ceiling. The lip portion 30 may extend a distance "l" from the periphery of the luminaire 10. If the distance l is too great, then a dark area may be perceived about the periphery of the luminaire 10 as the lip portion 30 is spaced from but substantially parallel with the light emitting lens of the basket assembly 18 and, therefore, little light will be incident on the lip portion 30. If the distance l is too small, then the angled portion of the baffle may extend onto the ceiling grid which may not be aesthetically pleasing. Thus, in some embodiments, the distance l may be from about 0.5 inches (1.25 cm) to about 2 inches (5.1 cm).

Additionally, the baffle assembly 20 recesses the light generation portion of the luminaire 10 above the plane of the ceiling tile. The light generation portion of the luminaire 10 is recessed above the ceiling tile such that the luminaire 10 is perceived as dimmer the farther away an occupant is from the luminaire 10. Recessing the light generation portion creates a cutoff angle such that at a sufficient distance from the luminaire 10, the light generation portion is no longer directly visible. However, recessing the light generation portion may also limit the ability of the luminaire to provide a wide distribution of light into the room. Furthermore, recessing the light generation portion above the ceiling tile may limit the distance available for mixing light from the LEDs inasmuch as the luminaire 10 must be no deeper than the depth "d."

The basket assembly 18 and the baffle assembly 20 may be designed to help facilitate mixing depth while still allowing for recessing the light generation portion above the ceiling tile. In particular, reducing the size of the basket assembly 18 to less than the total size of the luminaire 10 allows the basket assembly to be recessed above the ceiling tile. The smaller the basket assembly 18, the shallower the recess can be for a given shield angle. However, if the basket assembly is too small, it could be difficult to provide a desired light distribution and may appear unbalanced with respect to overall size of the luminaire 10. For example, in some embodiments, the ratio of the dimensions of the periphery of the baffle assembly 20 to the periphery of the basket assembly 18 may be from about 1.5:1 to about 3:1, e.g., about 2:1. Thus, the size of the basket assembly 18 may be balanced against the overall size of the luminaire 10 to provide good light distribution, a sufficient shield angle, a relatively shallow overall luminaire depth and aesthetically pleasing proportions.

Utilizing a basket assembly 18 that is smaller than the overall luminaire size results in the need for some supporting structure so that the luminaire 10 can be installed on a standard ceiling grid. The baffle assembly 20 provides this structure. Furthermore, design of the baffle assembly 20 should take into account how the baffle assembly 20 interacts with the light exiting the basket assembly 18.

By providing a slanted baffle assembly 20, light from the basket assembly 18 may be incident on the baffle assembly 20 to illuminate the baffle assembly 20. By illuminating the baffle assembly 20, the overall appearance of the luminaire 10 may be improved in that a partially illuminated baffle assembly 20 will reduce the contrast between the basket assembly 18 and the baffle assembly 20 and, thereby, avoid a sharp change in luminous intensity.

The degree to which the baffle assembly 20 is illuminated will depend on the degree of slant of the wall of the baffle assembly 20, the extent to which the basket assembly 18 extends beyond the baffle assembly 20 and the light distribution pattern from the basket assembly 18. Thus, the width "w" and the height "h" of the slanted portion of the baffle section define the relationship between the recess of the light generating portion of the luminaire 10 and the baffle assembly 20. If the degree of slant (i.e., angle) is too great for a given depth of recess, then too much light is lost on the baffle assembly and luminaire efficiency is unduly decreased. If the degree of slant is not great enough for a given depth of recess, then the basket assembly 18 is not sufficiently recessed above the ceiling and/or the baffle assembly 20 will appear dark, which can be aesthetically displeasing. Accordingly, in some embodiments of the present inventive subject matter, the ratio of w to h is from about 2 to about 3 and in some embodiments about 2.3. In particular embodiments, the width w is from about 130 to about 140 mm and the height h is from about 50 to about 60 mm. In some embodiments of the present inventive subject matter, the angle of slant is in the range of from about 20 degrees to about 40 degrees (i.e., the ratio of w to h is from about 2.75 to about 1.19). In some embodiments of the present inventive subject matter, the angle of slant is about 22 degrees (i.e., the ratio of w to h is about 2.48). In some embodiments of the present inventive subject matter, the angle of slant is about 28 degrees (i.e., the ratio of w to h is about 1.88). In some embodiments of the present inventive subject matter, the angle of slant is about 34 degrees (i.e., the ratio of w to h is about 1.48).

In one example of a representative embodiment, the outer perimeter of the rim measures about 2 feet by about 2 feet, and the outer perimeter of the basket assembly measures about 1 foot by about 1 foot, giving a ratio of the dimensions of the periphery of the baffle assembly 20 to the periphery of the basket assembly 18 of about 2:1. In such a device, preferably, the distances l and w, as defined above, are substantially uniform, whereby their sum will be about 6 inches. In some embodiments, the rim may slightly overlap a supporting structure in the ceiling, whereby the sum of a portion of l plus the entirety of w will be about 6 inches (and the opening defined by the supporting structure will be about 2 feet by about 2 feet.

In the cases of embodiments where the opening in the supporting structure is not square, e.g., 2 feet by 4 feet, the devices according to the present inventive subject matter can be modified in any desired way to provide the desired effect in the opening, e.g., to fill it, such as by using two devices (each measuring about 2 feet by 2 feet) side-by-side, or by providing a device in which the outer perimeter of the rim measures about 4 feet by about 2 feet, and the outer perimeter of the basket assembly measures about 3 foot by about 1 foot, with the sum of the distances l and w (or the sum of the distance w plus a portion of the distance l) being about 6 inches.

FIGS. 3 through 7 provide additional views of the luminaire 10 described above with reference to FIGS. 1 and 2.

Figure 8:
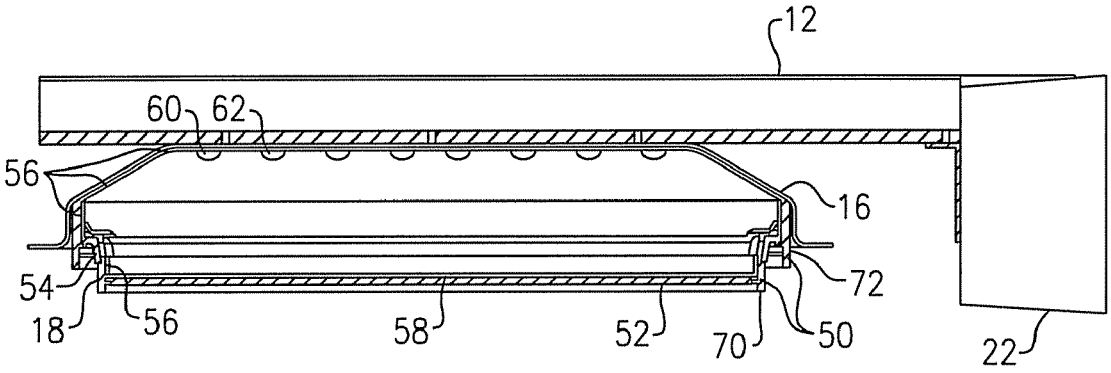
FIGS. 8 and 9 are more detailed views of the basket assembly of the luminaire of FIG. 1.
Figure 9:
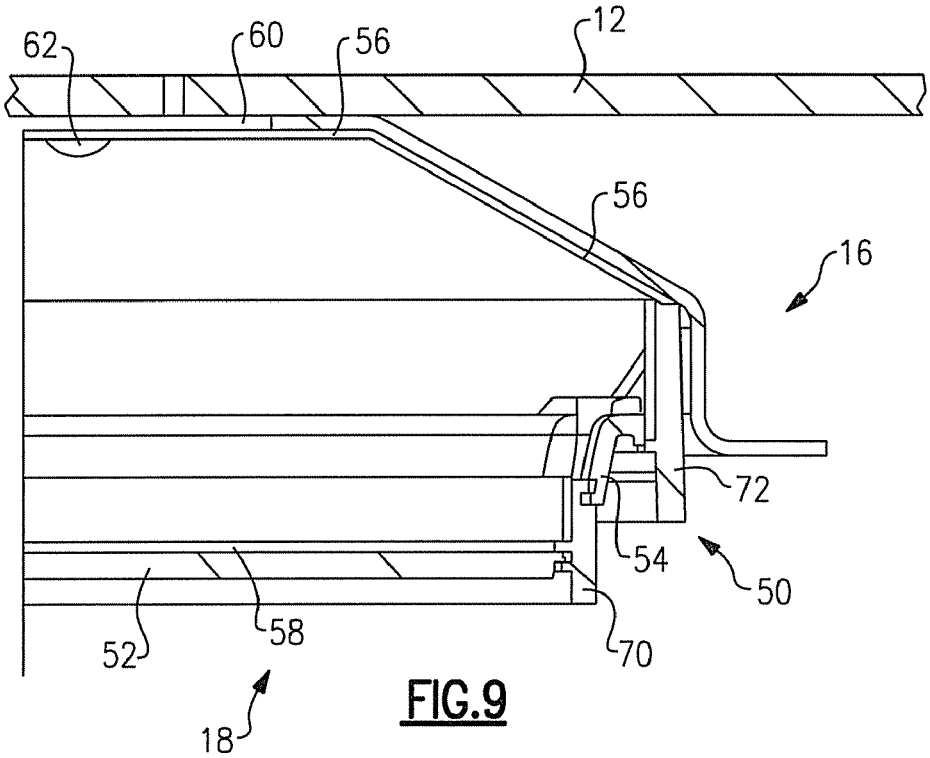
Figure 10:
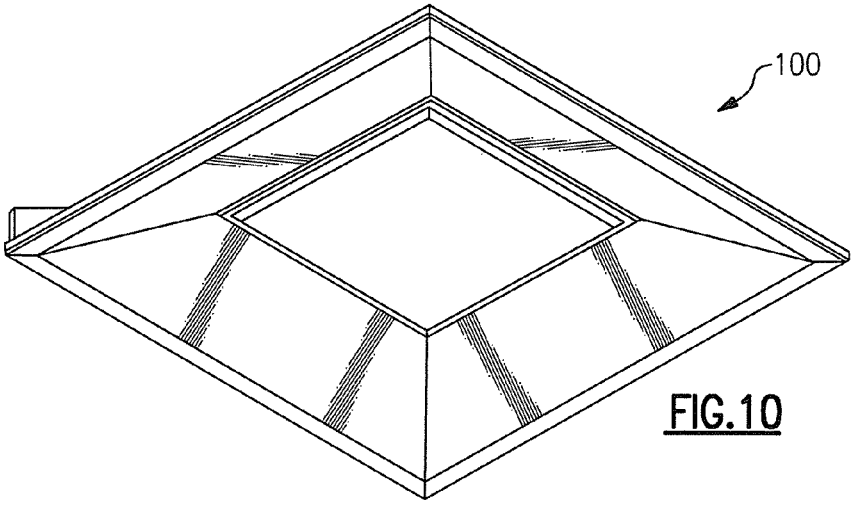
FIGS. 10-16 are views of alternative embodiments of the present inventive subject matter.
Figure 11:
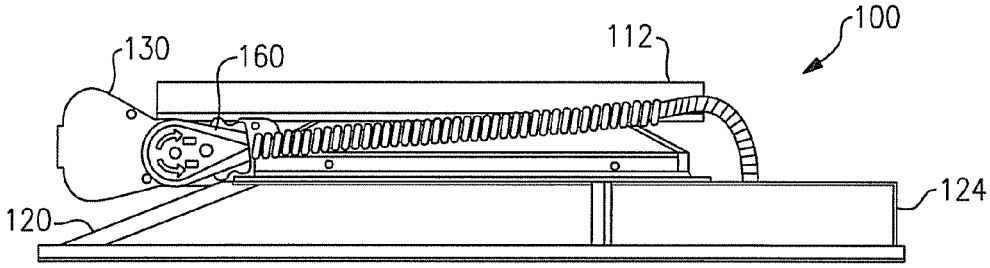
Figure 12:
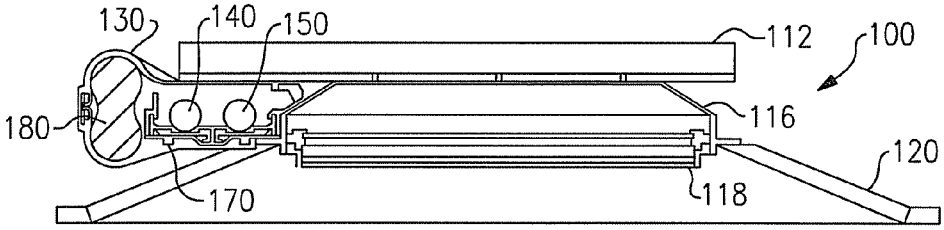
Figure 13:
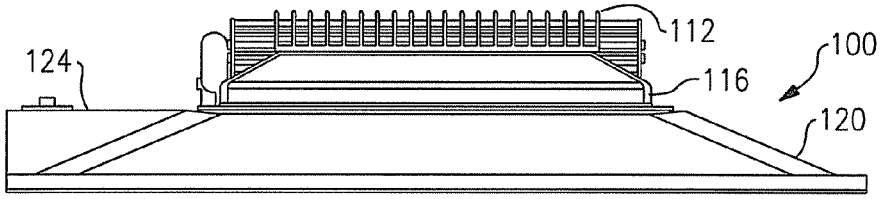
Figure 14:
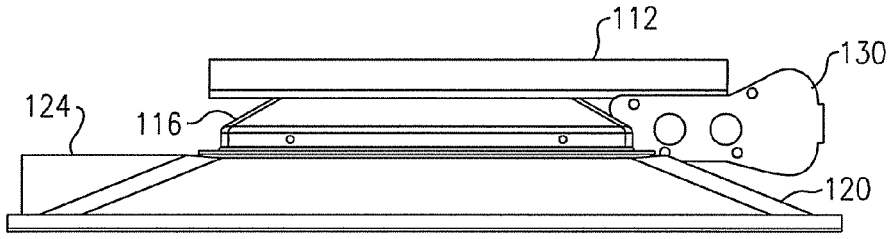
Figure 15:
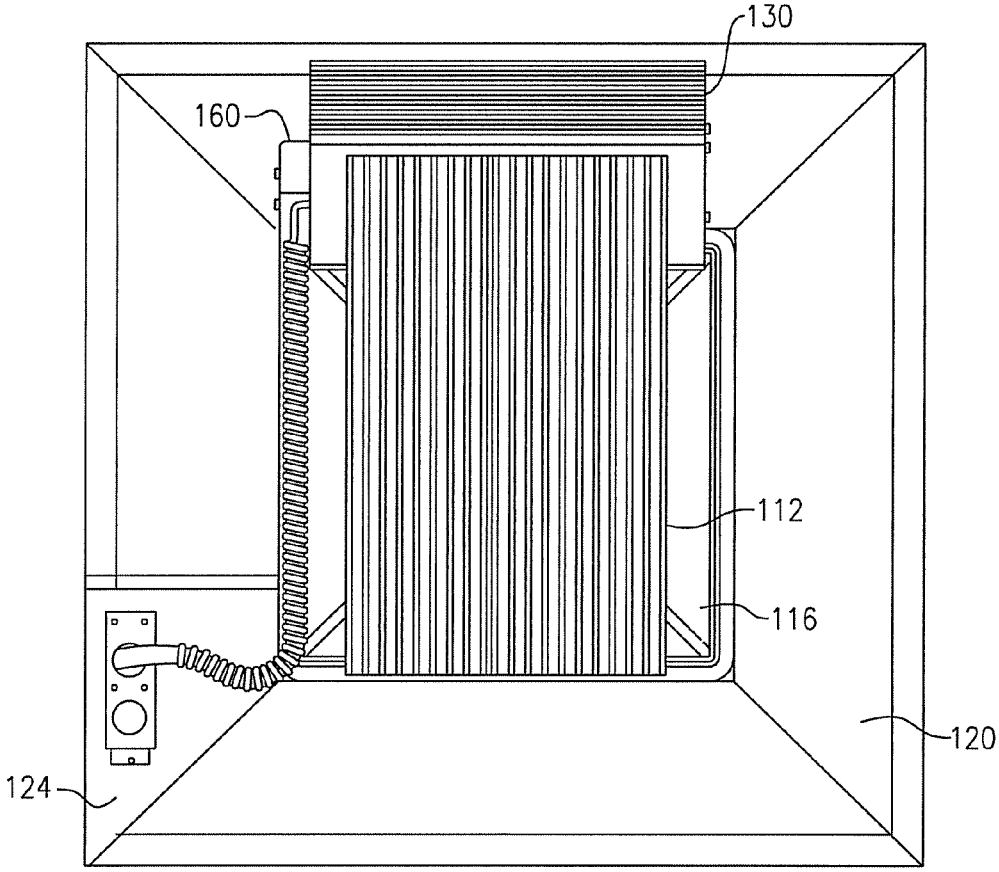
Figure 16:
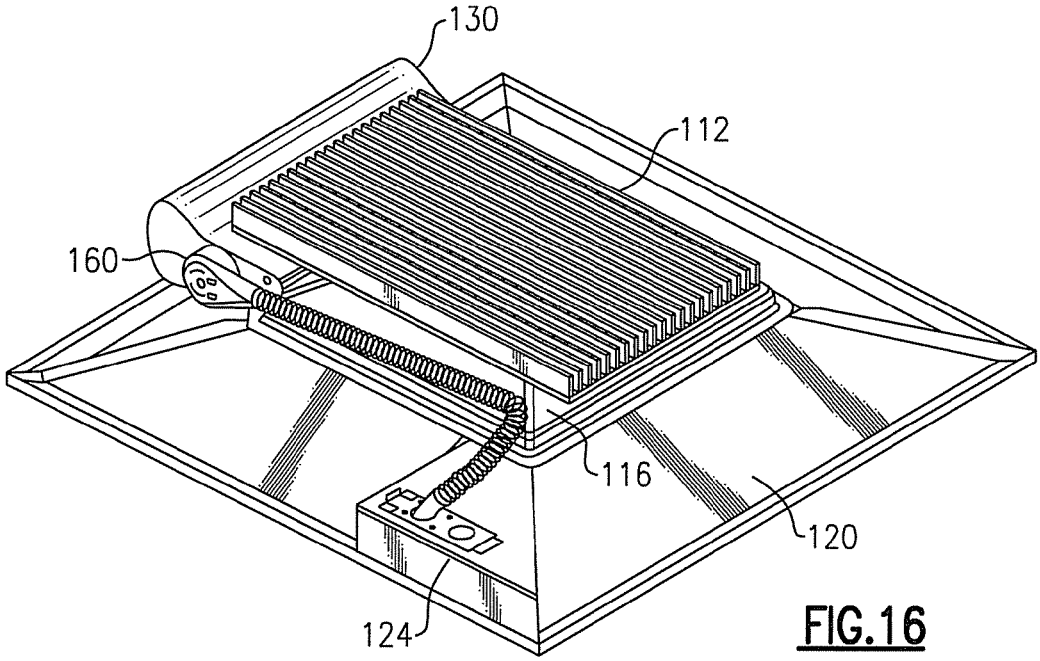

FIGS. 8 and 9 are more detailed cross-sectional view of the luminaire 10 without the baffle assembly 20. As seen in FIG. 8, the upper housing 16 is mounted to the heat sink 12. The upper housing 16 has an opening adjacent the heat sink 12 through which a PC board 60 having LEDs 62 mounted thereon extends. As discussed above, the PC board may be a metal core PC board and it may be thermally and mechanically coupled to the heat sink 12. A layer of MCPET® 56 is provided on all exposed internal faces of the upper housing 16, the PC board 60 and heat sink 12 and the basket assembly 18.

As is further illustrated in FIGS. 8 and 9, the basket assembly 18 may include a frame 50 that provides structural support for the basket assembly 18 and is configured to allow the basket assembly to be attached to the upper housing 16. The frame 50 may include an internal frame member 70 and an external frame member 72 that respectively define two openings in the basket assembly 18. The internal frame member 70 defines a central opening in which a first lens 52 is provided. The internal frame member 70 and the first lens 52 together define a first light transmitting window of the basket assembly 18.

As discussed above, one or more films or other diffusing structures 58 may be provided on or as part of the first lens 52. The one or more films may, for example, be held in place by one or more tabs on each edge of the film 58 that is folded and extends onto the internal frame member 70. The tab may then be held in place by the MCPET® reflector 56 that is adhesively secured to the exposed surface of the internal frame member 70, thereby capturing the tab between the MCPET® 56 and the internal frame member 70.

The external frame member 72 surrounds the internal frame member 70 and is connected to the internal frame member 70, for example at the corners of the internal frame member 70. Thus, the external frame member 72 provides structural support for the internal frame member 70. At least a second lens 54 is provided in the space between the external frame member 72 and the internal frame member 70. In particular embodiments, multiple second lenses are provided, one on each side of the internal frame 70. The space between the internal frame member 70 and the external frame member 72 and the second lens 54 define a second light transmitting window of the basket assembly 18. The second lens 54 may have diffusing structures therein or thereon. While a single second lens 54 is described, multiple second lenses 54 could be provided. For example, a second lens 54 could be provided on each side of the square/rectangle defined by the internal frame member such that four second lenses and, corresponding, four second light transmitting windows, are provided in the basket assembly 18. Alternatively, a single second lens could be provided which extends all the way around the periphery of the internal frame member (e.g., shaped like a picture frame).

Figure 17:
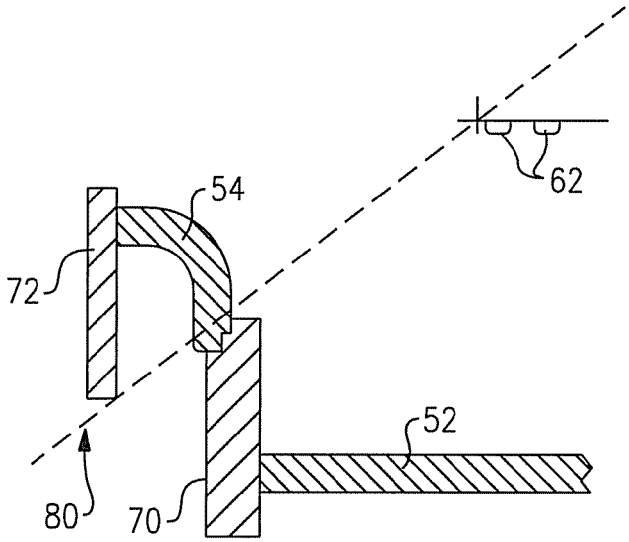
FIG. 17 is a detailed view of a part of an embodiment of a luminaire according to the present inventive subject matter.

In view of the importance of the gradient of light between the lens in the central opening (e.g., the first lens 52 in the embodiments described above) and the baffle assembly (i.e., the transition between the bright central region and the less bright baffle assembly), the precise shape and/or dimensions of the one or more second lenses (e.g., the second lens 54 depicted in the embodiment shown in FIGS. 8 and 9, and in the embodiment shown in FIG. 17) can be of critical importance.

In some embodiments according to the present inventive subject matter, the at least one second lens is/are preferably not flat (i.e., is not planar and parallel to a plane defined by the locations of light emission from the solid state light emitters). For example, the at least one second lens can be oriented diagonally (e.g., in contact with the external frame member at a location which is closer to a plane defined by the locations of light emission from the solid state light emitters than a location or locations of contact with the internal frame member) and/or can have one or more bends (i.e., can be non-planar, e.g., as depicted in FIG. 17, where the second lens 54 shown has a bend in it). In such embodiments, it is possible to ensure that a greater amount of light is cast onto the inside surface of the external frame member 72 and the outside surface of the internal frame member 70 (i.e., in FIG. 17, the right side of the external frame member 72 and the left side of the internal frame member 70). In such embodiments, the one or more second lenses preferably extend downward (i.e., in a direction which is perpendicular to a plane defined by the locations of light emission from the solid state light emitters, i.e., perpendicular to the first lens 52 depicted in FIG. 17) to some degree.

In some embodiments according to the present inventive subject matter, the dimensions and relative placement of the external frame member 72 and the internal frame member 70 are selected such that there is no direct line of sight from outside the lighting device (i.e., in a room in which the light is mounted) to any of the solid state light emitters in the lighting device. In other words, e.g., in the embodiment depicted in FIG. 17, (1) the opaque external frame member 72 extends far enough downward, (2) the opaque internal frame member 70 extends far enough upward, and (3) the location of frame members 70 and 72 relative to the LEDs 62 is such, that any line of sight extending below the external frame member 72 and above the internal frame member (e.g., the line of sight 80 depicted in FIG. 17) does not lead directly to any of the LEDs 62.

In one representative embodiment corresponding to the device depicted in FIG. 17, the external frame member 72 extends downward 0.375 inches from the lowermost point of contact between the second lens 54 and the external frame member 72, the lowermost portion of the internal frame member 70 is 0.43 inches below the lowermost portion of the external frame member 72, the inner surface of the external frame member 72 is spaced 0.3 inches from the outer surface of the internal frame member 70, and the distance between the inside surface of the external frame member 72 on one side of the lighting device and the inside surface of the external frame member 72 on the opposite side of the lighting device is 11.5 inches. In such an embodiment, the ratio of the total width of the basket to the width of the cavity (i.e., the space between the outer surface of the internal frame member 70 and the inner surface of the external frame member 72) is 11.5 inches to 0.6 inches, or about 19:1.

In some embodiments according to the present inventive subject matter, the first lens 52 is spaced from the solid state light emitters far enough to achieve a desired amount of light mixing and diffusion (i.e., to achieve a desired degree of uniformity of light color emission where different solid state light emitters emit light of differing colors and/or to obscure the solid state light emitters so that they do not appear as discrete light sources, these two objectives sometimes being distinct, as it is possible to provide good mixing of different colors of emissions but still to have a situation where an observer can see individual LED dies). The spacing needed to achieve a particular degree of mixing depends on the respective locations, colors and intensities of the light emissions, as well as the characteristics of any diffusing structures (e.g., the film 58 provided on the first lens 52 in the embodiments depicted in FIGS. 8 and 9) and the spacing between the solid state light emitters and the first lens 52. For example, it is well-known that different diffusing structures (e.g., different films) obscure (i.e., provide substantially uniform intensity) at different distances.

The frame members 70 and 72 may, for example, be injection molded from acrylonitrile-butadiene (ABS) and polycarbonate-acrylonitrile butadiene copolymer (PC/ABS), for example. The second lens 54 may be fabricated by injection molding and may be made of, for example, polycarbonate (PC), acrylic (PMMA), cyclic olefin copolymer (COC), styrene-butadiene copolymer (SBC) or styrene-acrylonitrile (SAN). The second lens 54 may be molded to have a matte or diffusing surface facing the upper housing 16.

By providing the one or more second light transmitting windows about the periphery of the first light transmitting window, the transition from the bright central portion of the basket assembly 18 to the less bright baffle assembly 20 may be softened by lower luminous intensity outer windows. In addition, the one or more second light transmitting windows can provide for better illumination of the outside surface of the inner frame assembly (i.e., the light which passes through the first lens typically would not illuminate the outside surface of the inner frame assembly, such that the outside surface of the inner frame assembly might be dark or less illuminated than is desirable—in such cases, light passing through the second lens(es) can allow for better illumination of the outside surface of the inner frame assembly.

FIGS. 10 through 16 are drawings of alternative embodiments of the present inventive subject matter. As seen in FIGS. 10 through 16, the luminaire 100 includes a heat sink 112 that extends beyond the periphery of an upper housing 116. A baffle assembly 120 and a basket assembly 118 are connected to the upper housing 116. The baffle assembly 120, basket assembly 118 and upper housing 116 may be substantially as described above with reference to the baffle assembly 20, the basket assembly 18 and the upper housing 16.

FIGS. 10 through 16 also illustrate a junction box 124 connected to the baffle assembly 120 for making a connection from electrical service to the luminaire 100. An accessory compartment 130 is mechanically and thermally connected to the heat sink 112. The accessory compartment 130 provides additional area to the heat sink 112. Heat from the LEDs may be dissipated through the heat sink 112 and through the accessory compartment 130.

The accessory compartment 130 may also house the power supply 170 for the light and optional features, such as a battery 180 and battery backup unit, and/or a dimming module. The dimming module and backup unit may be coupled to an external source for a dimming signal or an external indicator of backup status and test switch through the knock outs 140 and 150 in the end panel of the accessory compartment 130. The accessory compartment 130 may be connected to the junction box 124 through the connector and flexible conduit or armored cable 160.

Embodiments of the present inventive subject matter may be used with differing designs of the basket assembly 18. Thus, the present inventive subject matter may be used with basket assemblies 18 that appear as described in U.S. patent application Ser. No. 29/324,488 filed Sep. 12, 2008 (now U.S. Pat. No. D592,348, U.S. patent application Ser. No. 29/324,484 filed Sep. 12, 2008 (now U.S. Pat. No. D592,347 and/or U.S. patent application Ser. No. 29/324,486 filed Sep. 12, 2008 (now U.S. Pat. No. D601,741, the disclosures of which are incorporated herein by reference as if set forth in their entirety.

The selection of specific dimensions of the various parts of the light fixtures according to the present invention involve trade-offs among efficacy, shielding (i.e., minimizing glare and/or providing gradual changes in intensity in the various regions and/or among the various regions as a viewer changes positions) and depth of recess. It is always desirable to obtain efficacy which is as high as possible. In some instances, more of an emphasis is placed on shielding. In some instances, more of an emphasis is placed on the depth of recess (e.g., there is only a specific amount of room available, such as the distance between a drop ceiling and a fixed ceiling from which the drop ceiling is suspended). In addition, the larger a lens area is, the more effective the diffuser needs to be in order to avoid or minimize bright spots and/or color variations. If a lens area is very small, there is generally an increased potential for glare. In some aspects, the present invention makes it possible to easily create more uniform luminances within the various lenses.

While embodiments of the present inventive subject matter have been described with reference to a substantially square luminaire, other shapes, such as rectangles, may also be provided. Thus, for example, a 2'×4' luminaire could be provided by extending the dimensions of the various components of the luminaire one dimension but not the other.

Any two or more structural parts of the devices described herein can be integrated. Any structural part of the devices described herein can be provided in two or more parts (which are held together, if necessary).

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A lighting device, comprising:

a heat sink element;

an upper housing mounted to the heat sink element;

a basket assembly attached to the upper housing;

at least one solid state light emitter thermally coupled to the heat sink element; and a baffle assembly attached to the upper housing, the baffle assembly comprising a plurality of side walls and an end region, the end region defining a light exit opening, the light exit opening defining a first substantially planar area, at least one of the side walls of the baffle assembly extending from the end region at an angle of less than 90 degrees relative to the first substantially planar area.

2. A lighting device as recited in claim 1, wherein the baffle assembly comprises four side walls, and the four side walls define a substantially frustopyramidal shape.

3. A lighting device as recited in claim 1, wherein the angle is between 18 degrees and 27 degrees.

4. A lighting device as recited, in claim 3, wherein the baffle assembly comprises four side walls, and the four side walls define a substantially frustopyramidal shape.

5. A lighting device as recited in claim 1, wherein the light exit opening is substantially square.

6. A lighting device as recited in claim 1, wherein the at, least one, solid state light emitter is mounted on the heat sink.

7. A lighting device as recited in claim 1, wherein the lighting device further comprises a light emitter board mounted on the heat sink, the at least one solid state light emitter mounted on the light emitter board, the light emitter board thermally coupled to the heat sink, the at least one solid state light emitter thermally coupled to the light emitter board.

8. A lighting device as recited in claim 7, wherein the basket assembly, the upper housing and the light emitter board together define a light mixing chamber.

9. A lighting device as recited in claim 1, wherein the at least one solid state light emitter is an LED.

10. A lighting device as recited in claim 1, wherein the lighting device comprises a plurality of solid state light emitters.

11. A lighting device as recited in claim 10, wherein each of the plurality of solid state light emitters is an LED.

12. A lighting device as recited in claim 1, wherein at least a portion of the upper housing is substantially frustopyramidal.

13. A lighting device as recited in claim 1, wherein the basket assembly comprises at least one frame member and at least one lens.

14. A lighting device as recited in claim 13, wherein the lighting device further comprises at least one diffusing film mounted on the lens.

15. A lighting device as recited in claim 1, wherein the basket assembly comprises at least a first frame, the first frame comprising at least one first frame member and at least one second frame member, the first frame member defining a first opening, at least one first lens in the first opening, at least one space between the first frame member and the second frame member, at least one second lens in the space.

16. A lighting device as recited in claim 1, wherein the lighting device further comprises at least one additional component in contact with the heat sink element.

17. A lighting device as recited in claim 16, wherein the at least one additional component comprises at least one element selected from among a power supply module and a junction box.

18. A lighting device, comprising:

a heat sink element;

an upper housing mounted to the heat sink element;

a basket assembly attached to the upper housing;

at least one solid state light emitter thermally coupled to the heat sink element; and a baffle assembly attached to the upper housing, the basket assembly comprising at least a first frame, the first frame comprising at least one first frame member and at least one second frame member, the first frame member defining a first opening, at least one first lens being in the first opening, at least one space provided between the first frame member and the second frame member, at least one second lens in the space.

19. A lighting device as recited in claim 18, wherein the first frame consists of the first frame member and the second frame member, and the second lens covers an entirety of the space between the first frame member and the second frame member.

20. A lighting device as recited in claim 18, wherein:

the first frame consists of the first frame member and the second frame member, the second frame member comprises a second frame member first portion, a second frame member second portion, a second frame member third portion and a second frame member fourth portion, a first space is located between the first-second frame member first portion and the first frame member, a second space is located between the second frame member second portion and the first frame member, a third space is located between the second frame member third portion and the first frame member, a fourth space is located between the second frame member fourth portion and the first frame member, the first opening is a central opening and is substantially square, and a second lens is in each of the first, second, third and fourth spaces.

21. A lighting device as recited in claim 18, wherein the at least one solid state light emitter is mounted on the heat sink.

22. A lighting device as recited in claim 18, wherein the lighting device further comprises a light emitter board mounted on the heat sink, the at least one solid state light emitter mounted on the light emitter board, the light emitter board thermally coupled to the heat sink, the at least one solid state light emitter thermally coupled to the light emitter board.

23. A lighting device as recited in claim 22, wherein the basket assembly, the upper housing and the light emitter board together, define a light mixing chamber.

24. A lighting device as recited in claim 18, wherein the at least one solid state light emitter is an LED.

25. A lighting device as recited in claim 18, wherein the lighting device comprises a plurality of solid state light emitters.

26. A lighting device as recited in claim 25, wherein each of the plurality of solid state light emitters is an LED.

27. A lighting device as recited in claim 18, wherein at least a portion of the upper housing is substantially frustopyramidal.

28. A lighting device as recited in claim 18, wherein the lighting device further comprises at least one diffusing film mounted on the first lens.

29. A lighting device as recited in claim 18, wherein the lighting device further comprises at least one additional component in contact with the heat sink element.

30. A lighting device as recited in claim 29, wherein the at least one additional component comprises at least one element selected from among a power supply module and a junction box.

31. A lighting device, comprising:

a heat sink element;

an upper housing mounted to the heat sink element;

a basket assembly attached to the upper housing;

at least one solid state light emitter thermally coupled to the heat sink element; and a baffle assembly attached to the upper housing, the heat sink element extending farther in a first direction which is in a first plane than a largest dimension of the upper housing in any plane which is parallel to the first plane.

32. A lighting device as recited in claim 31, wherein the largest dimension of the upper housing is in a second plane which is parallel to the first plane.

33. A lighting device as recited in claim 32, wherein the baffle assembly comprises a plurality of side walls and an end region, the end region defining a light exit opening, the light exit opening defining a first substantially planar area, the first plane parallel to the first substantially planar area.

34. A lighting device as recited in claim 31, wherein the at least one solid state light emitter is mounted on the heat sink.

35. A lighting device as recited in claim 31, wherein the lighting device further comprises a light emitter board mounted on the heat sink, the at least one solid state light emitter mounted on the light emitter board, the light emitter board thermally coupled to the heat sink, the at least one solid state light emitter thermally coupled to the light emitter board.

36. A lighting device as recited in claim 35, wherein the basket assembly, the upper housing and the light emitter board together define a light mixing chamber.

37. A lighting device as recited in claim 31, wherein the at least one solid state light emitter is an LED.

38. A lighting device as recited in claim 31, wherein the lighting device comprises a plurality of solid state light emitters.

39. A lighting device as recited in claim 38, wherein each of the plurality of solid state light emitters is an LED.

40. A lighting device as recited in claim 31, wherein at least a portion of the upper housing is substantially frustopyramidal.

41. A lighting device as recited in claim 31, wherein the basket assembly comprises at least one frame member and at least one lens.

42. A lighting device as recited in claim 41, wherein the lighting device further comprises at least one diffusing film mounted on the lens.

43. A lighting device as recited in claim 31, wherein the basket assembly comprises at least a first frame, the first frame comprising at least one first frame member and at least one second frame member, the first frame member defining a first opening, at least one first lens in the first opening, at least one space between the first frame member and the second frame member, at least one second lens in the space.

44. A lighting device as recited in claim 31, wherein the lighting device further comprises at least one additional component in contact with the heat sink element.

45. A lighting device as recited in claim 44, wherein the heat sink element comprises a first side and a second side, the at least one additional component and the upper housing both in contact with the first side of the heat sink element.

46. A lighting device as recited in claim 44, wherein the at least one additional component comprises at least one element selected from among a power supply module and a junction box.

47. A lighting device as recited in claim 46, wherein the power supply module comprises a compartment in which there is a power supply.

48. A lighting device as recited in claim 44, wherein the upper housing is thermally coupled to the heat sink element.

49. A lighting device as recited in claim 48, wherein the baffle assembly is thermally coupled to the upper housing.

50. A lighting device as recited in claim 49, wherein the lighting device further comprises at least one additional component in contact with the heat sink element.

51. A lighting device as recited in claim 50, wherein the heat sink element comprises a first side and a second side, the at least one additional component and the upper housing both in contact with the first side of the heat sink element.

52. A lighting device as recited in claim 50, wherein the at least, one additional component comprises at least one element selected from among a power supply module and a junction box.

53. A lighting device as recited in claim 31, wherein the baffle assembly comprises a plurality of side walls and an end region, the end region defining a light exit opening, the light exit opening defining a first substantially planar area, at least one of the side walls of the baffle assembly extending from the end region at an angle of less than 90 degrees relative to the first substantially planar area.

54. A lighting device, comprising:

a heat sink element;

an upper housing mounted to the heat sink element;

a basket assembly attached to the upper housing;

at least one solid state light emitter thermally coupled to the heat sink element;

a baffle assembly attached to the upper housing; and at least one additional component in contact with the heat sink element.

55. A lighting device as recited in claim 54, wherein the at least one additional component comprises at least one element selected from among a power supply module and a junction box.

56. A lighting device as recited in claim 54, wherein the at least one solid state light emitter is mounted on the heat sink.

57. A lighting device as recited in claim 54, wherein the lighting device further comprises a light emitter board mounted on the heat sink, the at least one solid state light emitter mounted on the light emitter board, the light emitter board thermally coupled to the heat sink, the at least one solid state light emitter thermally coupled to the light emitter board.

58. A lighting device as recited in claim 57, wherein the basket assembly, the upper housing and the light emitter board together define a light mixing chamber.

59. A lighting device as recited in claim 54, wherein the at least one solid state light emitter is an LED.

60. A lighting device as recited in claim 54, wherein the lighting device comprises a plurality of solid state light emitters.

61. A lighting device as recited in claim 60, wherein each of the plurality of solid state light emitters is an LED.

62. A lighting device as recited in claim 54, wherein at least a portion of the upper housing is substantially frustopyramidal.

63. A lighting device as recited in claim 54, wherein the basket assembly comprises at least one frame member and at least one lens.

64. A lighting device as recited in claim 63, wherein the lighting device further comprises at least one diffusing film mounted on the lens.

65. A lighting device, comprising:

a heat sink element;

an upper housing thermally coupled to the heat sink element;

a basket assembly attached to the upper housing;

at least one solid state light emitter thermally coupled to the heat sink element; and a baffle assembly attached to the upper housing.

66. A lighting device as recited in claim 65, wherein the at least one solid state light emitter is mounted on the heat sink.

67. A lighting device as recited in claim 65, wherein the lighting device further comprises a light emitter board mounted on the heat sink, the at least one solid state light emitter mounted on the light emitter board, the light emitter board thermally coupled to the heat sink, the at least one solid state light emitter thermally coupled to the light emitter board.

68. A lighting device as recited in claim 67, wherein the basket assembly, the upper housing and the light emitter board together define a light mixing chamber.

69. A lighting device as recited in claim 65, wherein the at least one solid state light emitter is an LED.

70. A lighting device as recited in claim 65, wherein the lighting device comprises a plurality of solid state light emitters.

71. A lighting device as recited in claim 70, wherein each of the plurality of solid state light emitters is an LED.

72. A lighting device as recited in claim 65, wherein the lighting device further comprises at least one additional component in contact with the heat sink element.

73. A lighting device as recited in claim 72, wherein the at least one additional component comprises at least one element selected from among a power supply module and a junction box.

74. A lighting device as recited in claim 73, wherein the power supply module comprises a compartment in which there is a power supply.

75. A lighting device as recited in claim 73, wherein the baffle assembly is thermally coupled to the upper housing.

76. A lighting device as recited in claim 72, wherein the heat sink element comprises a first side and a second side, the at least one additional component and the upper housing both in contact with the first side of the heat sink element.

77. A lighting device as recited in claim 65, wherein the baffle assembly is thermally coupled to the upper housing.

78. A lighting device, comprising:

a basket assembly; and a baffle assembly, the baffle assembly comprising a plurality of side walls and an end region, the end region defining a light exit opening, the light exit opening defining a first substantially planar area, at least one of the side walls of the baffle assembly extending from the end region at an angle of less than 90 degrees relative to the first substantially planar area, a periphery of the basket assembly within a space defined by the baffle assembly.

79. A lighting device as recited in claim 78, wherein the baffle assembly comprises four side walls, and the four side walls define a substantially frustopyramidal shape.

80. A lighting device as recited in claim 78, wherein the angle is between 18 degrees and 27 degrees.

81. A lighting device as recited in claim 78, wherein the light exit opening is substantially square.

82. A lighting device as recited in claim 78, wherein the lighting device further comprises at least one light emitter.

83. A lighting device as recited in claim 82, wherein the light emitter comprises a plurality of solid state light emitters.

84. A lighting device as recited in claim 83, wherein each of the plurality of solid state light emitters is an LED.

85. A lighting device as recited in claim 78, wherein the basket assembly comprises at least one frame member and at least one lens.

86. A lighting device as recited in claim 85, wherein the lighting device further comprises at least one diffusing film mounted on the lens.

87. A lighting device as recited in claim 78, wherein the basket assembly comprises at least a first frame, the first frame comprising at least one first frame member and at least one second frame member, the first frame member defining a first opening, at least one first lens in the first opening, at least one space between the first frame member and the second frame member, at least one second lens in the space.

88. A lighting device as recited in claim 87, wherein the lighting device further comprises at least one light emitter.

89. A lighting device as recited in claim 88, wherein the light emitter comprises a plurality of solid state light emitters.

90. A lighting device, comprising:

a basket assembly; and a baffle assembly, the basket assembly comprising at least a first frame, the first frame comprising at least one first frame member and at least one second frame member, the first frame member defining a first opening, at least one first lens in the first opening, at least one space between the first frame member and the second frame member, at least one second lens in the space.

91. A lighting device as recited in claim 90, wherein the lighting device further comprises at least one light emitter.

92. A lighting device as recited in claim 91, wherein the light emitter comprises a plurality of solid state light emitters.

93. A lighting device as recited in claim 90, wherein the first frame consists of the first frame member and the second frame member, and the second lens covers an entirety of the space between the first frame member and the second frame member.

94. A lighting device as recited in claim 90, wherein:

the first frame consists of the first frame member and first, second, third and fourth second frame members, a first space is located between the first second frame member and the first frame member, a second space is located between the second second frame member and the first frame member, a third space is located between the third second frame member and the first frame member, a fourth space is located between the fourth second frame member and the first frame member, the first opening is a central opening and is substantially square, and a second lens is in each of the first, second, third and fourth spaces.

95. A lighting device as recited in claim 90, wherein the lighting device further comprises at least one diffusing film mounted on the first lens.

* * * * *

UNITED STATES PATENT AND TRADEMARK OFFICE

CERTIFICATE OF CORRECTION

PATENT NO. : 8,136,965 B2
APPLICATION NO. : 12/116346
DATED : March 20, 2012
INVENTOR(S) : Paul Kenneth Pickard and Gary David Trott It is certified that error appears in the above-identified patent and that said Letters Patent is hereby corrected as shown below:

IN THE CLAIMS:

Column 18

*Claim 6, Line 64*: please delete the second ","

Column 19

*Claim 18, Line 50*: please delete "being"

*Claim 18, Line 51*: please delete "provided"

*Claim 20, Line 66*: please delete the second occurrence of "first"

Column 21

*Claim 52, Line 56*: please delete ","

Signed and Sealed this
Twenty-sixth Day of June, 2012

David J. Kappos

David J. Kappos
*Director of the United States Patent and Trademark Office*